United States Patent [19]

O'Brien

[11] 4,205,220

[45] May 27, 1980

[54] ELECTROGRAPHIC FUSING APPARATUS AND METHOD

[75] Inventor: Robert J. O'Brien, Rochester, N.Y.

[73] Assignee: Eastman Kodak Company, Rochester, N.Y.

[21] Appl. No.: 492,797

[22] Filed: Jul. 29, 1974

Related U.S. Application Data

[63] Continuation of Ser. No. 254,278, May 17, 1972, abandoned.

[51] Int. Cl.[2] ..... H05B 1/00; G03G 15/00

[52] U.S. Cl. ..... 219/216; 219/388

[58] Field of Search ..... 219/216, 388, 469–471; 432/59, 60, 227, 228

[56] References Cited

U.S. PATENT DOCUMENTS

| | | | |
|---|---|---|---|
| 2,807,703 | 9/1957 | Roshon, Jr. | 219/216 |
| 3,445,626 | 5/1969 | Michaels | 219/388 X |
| 3,464,680 | 9/1969 | Nakamura | 219/216 X |
| 3,474,223 | 10/1969 | Leiga et al. | 219/216 |
| 3,655,280 | 4/1972 | Zoppoth | 219/216 X |

*Primary Examiner*—C. L. Albritton

*Attorney, Agent, or Firm*—John D. Husser

[57] ABSTRACT

Loose toner particles carried by a flexible support are fused thereto by cylindrically curling the support about the longitudinal axis of a flashlamp, and momentarily energizing the flashlamp while the toner-bearing support is curled thereabout. A transport mechanism, adapted for use in a high-speed recording apparatus, advances a toner-bearing sheet along a circular path such that the toner-bearing surface of the sheet is untouched and continuously faces toward the center of curvature of the path.

5 Claims, 2 Drawing Figures

ELECTROGRAPHIC FUSING APPARATUS AND METHOD

The present application is a continuation of U.S. Ser. No. 254,278, filed on May 17, 1972, in the name of Robert Joseph O'Brien, now abandoned.

CROSS-REFERENCE TO RELATED APPLICATIONS

Reference is made to commonly assigned U.S. patent application Ser. No. 254,278 (now abandoned) entitled ELECTROGRAPHIC FUSING APPARATUS AND METHOD, filed on May 17, 1972, in the name of Robert Joseph O'Brien of which the present application is a continuation.

BACKGROUND OF THE INVENTION

The present invention relates to electrography and, more specifically, to methods and apparatus for fusing electroscopic toner images onto a supporting surface.

In electrography, latent electrostatic images formed on the surface of an electrographic recording element are rendered visible by the selective deposition of electroscopic toner particles. The developed or toned image so formed may be either permanently affixed to the recording element surface or transferred to a paper receiving sheet before being permanentized.

While many techniques are known for affixing or fusing electrographic toner images to a supporting surface, including heat fusing, pressure fusing and vapor fusing, none has proven by itself, or in combination, totally satisfactory for many electrographic applications. Generally, it has been difficult to construct an entirely satisfactory heat fuser having a short warm-up time, high efficiency and ease of control. A further problem associated with heat fusers has been their tendency to burn or scorch the support material. On the other hand, pressure fusing, whether hot or cold, has created problems with image offsetting, and vapor fusing typically employs a toxic solvent which renders it commercially unfeasible for many applications.

In addition to the fusing techniques mentioned above, radiant flash fusing has been considered. One advantage of flash fusing over other known techniques is that the energy, which is propagated in the form of electromagnetic waves, is instantaneously available and requires no intervening medium for its propagation. Moreover, such apparatus requires no long warm-up time and is capable of great speed.

While having many advantages, the flash fusing technique has not been commercially adapted, primarily due to its inefficient use of available radiant energy. Typically, the toner image constitutes a relatively small percentage of the total surface area subjected to radiant energy. Because of the properties of most copy material and the geometry of flash fusing apparatus heretofore considered, much of the radiant energy available for fusing is wasted by being transmitted through the copy material or by being reflected away from the fusing area.

In addition to the inefficient use of available energy by conventional radiant flash fusing devices, another disadvantage associated therewith has been the nonuniformity of image fixing produced thereby. This problem is primarily due to the fact that it has been difficult to produce highly uniform irradiance over a large surface area from a relatively small source such as a flashlamp.

Uniform irradiance over a small portion of the copy material to be fused can be achieved by positioning the flashlamp as close as possible to such copy material but this arrangement suffers the disadvantage of requiring incremental fusing of the copy sheets.

While considerable effort has been expended in providing schemes for enhancing the efficiency and uniformity of fix of electrographic flash fusing systems, most efforts have been directed toward the provision of specially contoured reflecting surfaces which are designed to at least partially surround the flashlamp and thereby conserve energy via multiple reflections. In addition to being costly to fabricate, such reflecting surfaces tend to become contaminated by loose toner particles and thereby necessitate frequent cleaning operations. The contamination becomes particularly acute when the flashlamp and reflector are placed in close proximity to the toner bearing copy material so as to provide the desired uniform irradiance thereof.

SUMMARY OF THE INVENTION

According to the invention, loose toner particles carried by a flexible support are fused thereto by cylindrically curling the support about the axis of a flashlamp, such as a xenon flashlamp, and energizing the flashlamp. Apparatus for carrying out the invention process includes an electrostatic transport mechanism which serves to advance a toner-bearing flexible member, such as a sheet of copy paper, along a circular path such that the toner-bearing surface of the member is untouched and continuously faces toward the center of curvature of the path where the flashlamp is situated. The flash fusing apparatus of the invention employs the copy material itself as a reflector. Light emanating from the flash lamp and impinging upon the copy material is absorbed by the toner particles but is reflected from the toner free non-image areas of the copy material to another area and so on, thereby increasing the amount of energy which is absorbed by the toner particles. Since the copy sheet itself acts as the energy reflector and each cycle of the copying machine brings a new copy sheet into the fusing station, the problem of spurious toner deposits on the reflector surface is eliminated. Moreover, unlike similar prior art devices which require several repetitive pulses of the flashlamp to fuse the entire toner image, the geometric configuration of the copy sheet, energy reflector enables the apparatus of the present invention to accomplish such fusing via a single flash.

The objects of the invention and its various advantages will become quite apparent to those skilled members of the art from the ensuing detailed description of a preferred embodiment, reference being made to the accompanying drawings wherein:

DETAILED DESCRIPTION OF A PREFERRED EMBODIMENT

Figure 1:
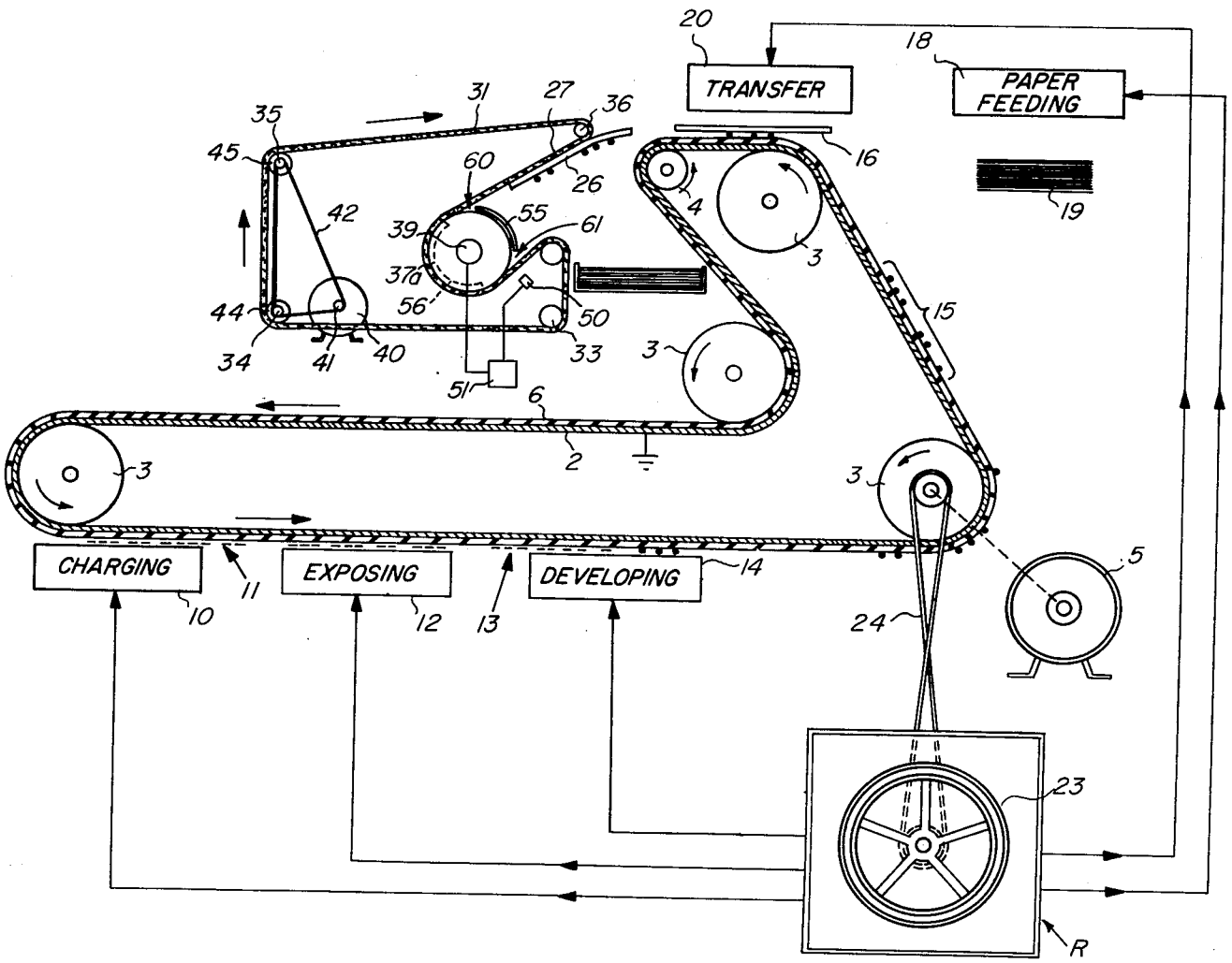
FIG. 1 is a schematic diagram illustrating an electrographic recording apparatus embodying the fusing apparatus of the invention.

Referring now to FIG. 1, an electrophotographic copier wherein the invention has particular utility is shown to comprise an endless electrophotographic recording element 2 which is driven about rollers 3 and 4 along a predetermined endless path by a motor 5, the latter being coupled with one of the rollers by means not shown. The endless recording element generally comprises a photoconductive belt 6 which is provided with an electrically grounded conductive backing 8. Disposed along the path are the various electrophotographic stations which serve to form a toner image of the document being copied upon the outer photoconductive surface of the recording element. As the recording element passes charging station 10, a portion of the photoconductive surface thereof receives a uniform electrostatic charge 11 (shown, for the purposes of illustration, as a negative charge) from a corona discharge source or the like. Upon being uniformly charged, the charge-bearing surface is advanced past an exposure station 12 where it is imagewise exposed to actinic radiation in accordance with the light and dark areas of the original document. Such imagewise exposure serves to selectively dissipate the uniform charge on the photoconductive surface to form an electrostatic latent image 13 corresponding to the indicia on the original document. Development of the electrostatic image is accomplished as that portion of the recording element bearing such image passes the development station 14, where it is subjected to an electrophotographic developer. Such a developer commonly comprises a mixture of electroscopic toner and carrier particles, the latter serving to carry the toner particles by generating tribo-electric charges thereon. During the development process, the toner particles are separated from the carrier particles by the stronger forces associated with the electrostatic image and are deposited on the surface of the photoconductive belt to form a toner image 15.

To reuse that portion of the recording element bearing the toner image, the toner image is transferred to a paper receiving sheet 16 on which the toner can be permanently fused. Such transfer is commonly effected by a paper feeding device 18 which feeds sheets of paper from a paper supply 19 to a transfer station 20 simultaneously with the passage therepast of the toner image-bearing belt 6. Transfer station 20 commonly comprises means for electrostatically charging the paper receiving sheet so as to attract toner particles from the surface of the recording element thereto. After the toner image is transferred to the paper receiving sheet, the sheet is peeled away from the recording element as the latter passes over small roller 4.

A shift register R, such as disclosed in U.S. Pat. No. 3,606,532, issued to Shelffo et al, serves to control the timing of the electrophotographic operations and to synchronize the feeding of the paper receiving sheets with the movement of the photoconductive recording element. Shift register R. includes a rotatable segmented and slotted cylinder 23 which is driven by suitable means, such as belt 24 extending from a pulley 25, mounted for rotation with roller 3, so that movement of the shift register is in direct response to movement of the photoconductive recording element.

Figure 2:
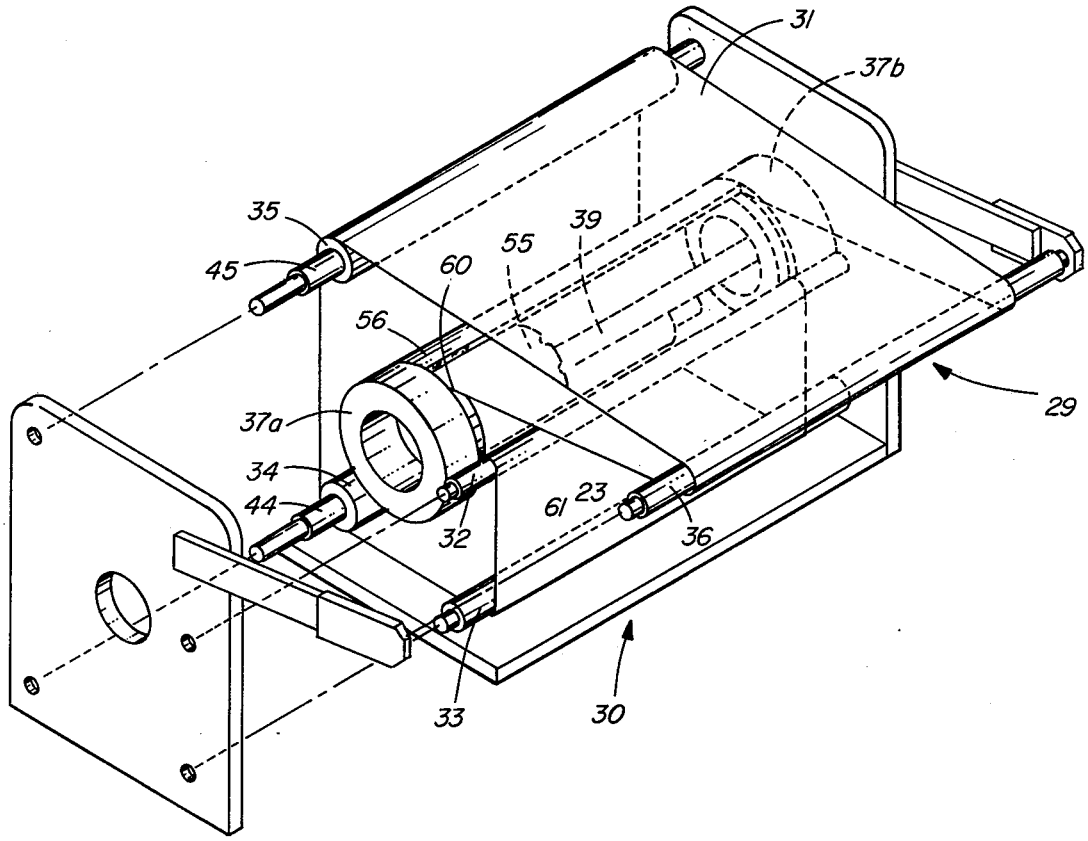
FIG. 2 is a detailed perspective view of a preferred embodiment of the transport mechanism comprising the flash fusing apparatus of the invention.

As transfer sheet 16 separates from recording element 2, the leading edge 26 thereof is electrostatically attracted toward the lower leg 27 of the transport mechanism 29 which comprises the fusing apparatus 30 of the invention. Transport mechanism 29 includes an endless web 31 of dielectric material, such as polyethyleneterephthalate film, and transport rollers 32, 33, 34, 35, 36 and 37. Web 31 is advanced in the direction indicated by the arrows by a motor 40, the drive shaft 41 of which is operatively coupled to transport rollers 34 and 35 via belt 42 and pulleys 44 and 45 which, as best shown in FIG. 2, are journalled for rotation with rollers 34 and 35, respectively. Transport rollers 34 and 35 are preferably fabricated from rubber or otherwise insulator-coated so as to impart an electrostatic charge to web 31 as the latter pass thereover.

As web 31 and recording element 2 continue to advance in the directions indicated by the arrows, the entire toner-bearing transfer sheet 16 is caused to electrostatically adhere to the web and be transported thereby along a path defined by the transport rollers 32–37. Transport mechanism 29 is positioned relative to recording element 2 such that the transfer sheet 16, as it becomes separated from the recording element, electrostatically adheres to the central portion of web 31. It should be noted that, due to the design of the transport mechanism, only the rear surface of sheet 16 (i.e., that surface which bears no toner image) comes into contact with the transport operation.

Whereas transport rollers 32 through 36 extend across the entire width of web 31, rollers 37*a* and 37*b* (which are spacedly arranged and rotatably mounted about a common axis) contact only the edge portion of web 31. For reasons to become apparent below, the circumference of rollers 37*a* and 37*b* is approximately twice the linear length of receiver sheet 16, assuming the sheet is advanced in a direction parallel to its length, and the spacing between rollers 37*a* and 37*b* is slightly greater than the width of receiver sheet 16.

Disposed between rollers 37*a* and 37*b* and along the longitudinal axes thereof, is an elongated source of radiant energy 39, preferably a xenon flashlamp. A pair of curved members 55 and 56, each having a cylindrical shape, partially surround the rollers 37*a* and 37*b* and the radiant flash energy source 39 and act as a light baffle. It is difficult, from a paper transport viewpoint, to curl the transfer sheet 16 completely about the longitudinal axis of the radiant flash energy source 39. The lateral edges of members 55 and 56, therefore, define rectilinear entrance and exit apertures 60 and 61, respectively, through which web 31 and transfer sheet 16 can enter and leave a fusing area which partially surrounds the radiant flash energy source 39. As the edges of that portion of web 31 which transports transfer sheet 16 passes over rollers 37*a* and 37*b*, the transfer sheet 16 follows a curved path in the fusing area, corresponding to that portion of a cylinder defined by the curved member 56. To energize source 39 at a time when the entire transfer sheet 16 is curled thereabout, a sensing member 50, such as a photocell, is arranged between rollers 37*a* and 37*b* to sense the leading edge 26 of transfer sheet 16 just before such edge arrives at the exit aperture 61.

The output of the sensing member 50 is used to activate a conventional trigger circuit 51 which is used to energize the radiant flash energy source 39. To conserve the radiant energy emanating from the source 39 which is directed toward the member 55, the inner surface of member 55 is preferably as reflective to the radiant energy as is the non-image areas of the diffusely reflecting transfer sheet 16. Supplemented by the reflecting surface of member 55, the toner bearing transfer sheet acts as an integrating sphere, producing a multitude of internal reflections and substantially uniform irradiation over the entire transfer sheet 16.

It has been found that a xenon flashlamp operating at power levels between 600 and 700 joules produces good toner fusion. When operating in this range, the wavelength of the output of the flashlamp is in the same region where the white paper transfer sheet 16 has the least absorptivity. The non-image areas of the transfer sheet 16 are, therefore, highly reflective of the impinging energy. The black toner particles, on the other hand, absorb most of the energy which they receive. Pulse durations between 0.25 and 1.5 milliseconds were found to provide acceptable fusing with pulses between 0.5 and 1.2 milliseconds giving better fusing results. It has been found that longer pulses of energy are required as the power level increases; e.g., at a pulse width of 15 milliseconds, 820 joules are required for acceptable fusion. Power input to the flashlamp is provided by a conventional direct current power supply with an adjustable voltage.

While the invention has been disclosed with particular reference to apparatus which is adapted to curl the toner-bearing sheet about the flashlamp axis, it is apparent that deviations from a perfectly cylindrical configuration could be made without departing from the spirit and scope of the invention. A cylindrical configuration is preferred, however, primarily because of its low cost and geometric simplicity, providing uniform irradiance to all points on the cylindrical surface from a flashlamp positioned along the central axis thereof. Moreover, it should be apparent that a cylindrical configuration of smaller diameter could be used, in which case it would be necessary to fuse the toner image in a piecemeal fashion, energizing the flashlamp a number of times as different portions of the toner-bearing sheet become curled about the flashlamp.

I claim:

1. An improved flash fusing apparatus for fusing toner images onto a copy sheet comprising:

an elongated flashlamp, a cylindrically shaped member circling said flashlamp along the longitudinal axis thereof, and means for positioning a copy sheet bearing toner images along the cylindrical member to form a circular path around said flashlamp whereupon energizing said lamp uniform direct radiation is imparted to the sheet to fuse the toner particles at a reduced power output.

2. Apparatus according to claim 1 including sensing means for detecting the lead edge of sheet to provide a signal to energize the flashlamp.

3. The invention according to claim 1 wherein said flashlamp comprises a xenon flashlamp having a pulse width of between 0.25 and 1.5 milliseconds and operating at an input power level of between 600 and 800 joules.

4. The invention according to claim 1 wherein said positioning means includes an endless web composed of a dielectric material, means for imparting an electrostatic charge to said web to render said web attractive to such a sheet and means for advancing said web around said flashlamp.

5. The invention defined in claim 1 wherein said flashlamp is adapted to emit a pulse of high intensity radiant energy comprised primarily of wavelengths that are substantially reflected by a paper copy sheet positioned by said positioning means and substantially absorbed by such toner images on that sheet whereby radiant energy from said flashlamp will be reflected by non-image bearing portions of such sheet toward other portions of such sheet.

* * * * *